United States Patent [19]

Cyphers

[11] Patent Number: 4,992,633

[45] Date of Patent: Feb. 12, 1991

[54] CONTAINED PRESSURE ACTIVATED SWITCH

[75] Inventor: Norman A. Cyphers, Rogers, Minn.

[73] Assignee: Wagner Spray Tech Corporation, Minneapolis, Minn.

[21] Appl. No.: 379,109

[22] Filed: Jul. 13, 1989

[51] Int. Cl.[5] ..... H01H 35/30

[52] U.S. Cl. ..... 200/81.9 R; 73/730; 73/861.47; 417/38

[58] Field of Search ..... 116/70, 270; 417/38, 417/63; 128/DIG. 12; 340/606, 611; 307/118; 73/861.42, 861.47, 730; 92/90; 200/81.8, 81 R, 81.9 R, 81.9 M

[56] References Cited

U.S. PATENT DOCUMENTS

| | | | |
|---|---|---|---|
| 1,176,907 | 3/1916 | Kraft et al. . | |
| 3,195,170 | 7/1965 | Howard . | |
| 3,424,883 | 1/1969 | Heskett | 417/38 |
| 4,065,969 | 1/1978 | Dinwiddle . | |
| 4,090,404 | 5/1978 | Dupont et al. . | |
| 4,335,999 | 6/1982 | Lamontagne | 200/81.9 R |
| 4,369,780 | 1/1983 | Sakai | 200/81.9 R |
| 4,446,344 | 5/1984 | Fiedler | 200/81 R |
| 4,499,347 | 2/1985 | Richards | 200/81.9 M |

FOREIGN PATENT DOCUMENTS

| | | |
|---|---|---|
| 328806 | 1/1917 | Fed. Rep. of Germany . |
| 1277147 | 9/1968 | Fed. Rep. of Germany . |
| 57-80501 | 5/1982 | Japan . |
| 284679 | 2/1928 | United Kingdom . |

*Primary Examiner*—Gerald P. Tolin

*Attorney, Agent, or Firm*—Hill, Van Santen, Steadman & Simpson

[57] ABSTRACT

A mechanical pressure switch is provided which includes a conduit that is expandable and contractable in response to the pressure of fluid passing through the conduit. A switch is mounted in a fixed position relative to one portion of the conduit and an actuator is mounted in a fixed position relative to a second, spaced portion of the hose such that the switch will be mechanically activated and deactivated by movement of the actuator relative to the switch in response to pressure changes in the conduit. Preferably the relative positions of the actuator and switch are adjustable in the same direction as the expansion and contraction of the conduit.

15 Claims, 2 Drawing Sheets

CONTAINED PRESSURE ACTIVATED SWITCH

BACKGROUND OF THE INVENTION

The present invention relates to pressure switches and more particularly to a pressure switch which mechanically detects the expansion and contraction of a conduit due to pressure changes of a fluid within said conduit.

In various applications it is desireable for certain elements such as pumps to be turned on or off according to the pressure within a conduit. Thus, there is a need to be able to measure the pressure within the conduit and to activate or deactivate an element in response to receipt of a sensed pressure. British Patent No. 284,679 discloses a pressure gauge using a tubular distendable element surrounded by a spring. As pressure increases within the tubular element, the element extends and the extension is shown by an indicator provided with markings. A similar arrangement is disclosed in U.S. Pat. No. 1,176,907. In that patent an expansion tube moves an extension viewable through an observation slot marked with gradiations. The higher pressures cause the tube to extend in length while lower pressures cause it to contract.

In U.S. Pat. No. 4,065,969 an apparatus is disclosed for detecting internal pressure of a fluid conduit including means for detecting lateral expansion and contraction of a thin-walled tubular element through compression of a piezo-conductive material placed between the thin-walled tubular member and an exterior rigid tube. Similarly, U.S. Pat. No. 4,090,404 detects the internal pressure within a conduit by clamping the conduit at two spaced locations and by employing detection means between the two clamped locations, the detection means being in the form of strain gauges which measure the lateral expansion of the conduit between the two clamped portions of the conduit.

SUMMARY OF THE INVENTION

The present invention provides a mechanical pressure switch which mechanically responds to expansion and contraction of a portion of a conduit in response to the pressure within the conduit to actuate a switch which controls an operating element such as a pump. By such an arrangement, the present invention avoids conversion of expansion and contraction movement into an electrical signal such as required by the use of strain gauges or pezio-electric material and instead the present invention utilizes the expansion or contraction itself to actuate a controlling switch.

Expansion and contraction is achieved by forming a portion of the conduit from a material which laterally expands in response to an increase in internal pressure, the lateral expansion causing a longitudinal contraction. In a preferred embodiment of the invention one portion of the conduit is clamped to a fixed member so as to be rigidly held and a second portion of the conduit is free to move longitudinally. A switch is held at one portion of the conduit, for example on the rigidly secured portion, and an actuating projection engageable with the switch actuator is held on the other conduit portion, for example the longitudinally movable portion. Thus, when pressure increases within the conduit, the conduit expands and the two portions move closer together as the longitudinal length of the conduit decreases. The extent of longitudinal contraction or expansion precisely relates to the internal pressure within the conduit and thus actuation of the switch can be calibrated with a high degree of accuracy. The actuating projection can be an axially adjustable member, such as a threaded cylinder held in an internally threaded aperture, in order to provide adjustability of the pressure level at which the switch is actuated.

In a preferred embodiment, the conduit between the two portions is in the form of a braided hose which has a measureable and consistent longitudinal expansion and contraction relative to the internal pressure within the hose. The pressure switch is mounted on the fixed portion of the conduit and the switch actuator projection is mounted on a portion of the hose free to move axially.

DETAILED DESCRIPTION OF THE PREFERRED EMBODIMENTS

Figure 1:
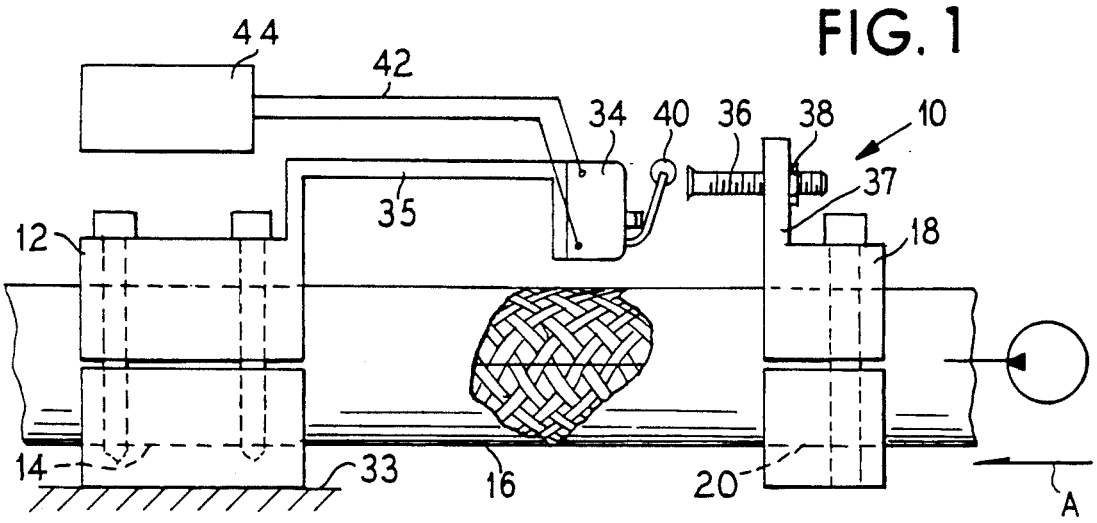
FIG. 1 is a side elevational view of a mechanical switch actuator embodying the principles of the present invention shown in a low pressure configuration.
Figure 3:
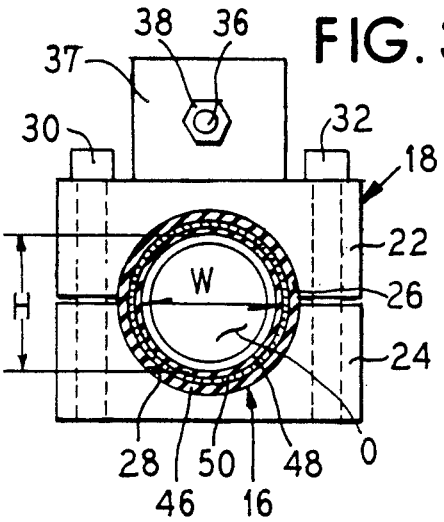
FIG. 3 is an end sectional view taken generally along the line III—III of FIG. 2.

In FIG. 1 there is illustrated a mechanical pressure switch generally at 10 which includes a first split block 12 rigidly clamped to a first portion 14 of a conduit 16. A second split block 18 is rigidly clamped to a second portion 20 of the conduit 16 spaced from the first split block 12. As seen in FIG. 3, the split block 18 has a top portion 22 and a bottom portion 24 each with a semi-circular recess 26, 28 which clampingly engage the hose 16 by operation of clamping screws 30, 32 which draw the two halves 22, 24 of the split block 18 together.

In a preferred arrangement, one of the split blocks, shown in the particular embodiment illustrated in the drawings as the first split block 12 is rigidly mounted to a support 33 external of the pressure switch 10 so that its associated clamped hose portion 14 is held in a fixed position. The second split block 18 is free to move.

One of the split blocks, shown in the particular embodiment illustrated in the drawings as the first split block 12, carries a microswitch 34 on a bracket 35. The other split block 18 carries an actuator projection 36 on a bracket 37 which, in the embodiment illustrated, comprises a longitudinally adjustable element in the form of an externally threaded cylinder mated with an internally threaded nut 38 mounted on the second split block 18. The actuator projection 36 is engageable with an actuator element 40 on the microswitch 34 such that longitudinal movement between the two blocks 12, 18 will actuate or deactuate the microswitch 34. The microswitch 34 is connected by appropriate electrical lines 42 to a control means 44 which in turn can operate other devices such as a pump P or other source of pressurized fluid to increase or decrease the pressure within the conduit. Pressurized fluid may flow through the conduit 16 from the pump P in a fluid flow direction indicated by the arrow A.

The conduit 16 is selected to have a consistent lateral and longitudinal expansion and contraction characteristic in response to pressure increases and decreases within the conduit. For example, the conduit can be in the form of a braided hose which, as illustrated in FIG. 3, may include an external rubber or plastic sheathing 46 and an internal plastic or rubber sheathing 48 sandwiching a central braided portion 50.

Figure 2:
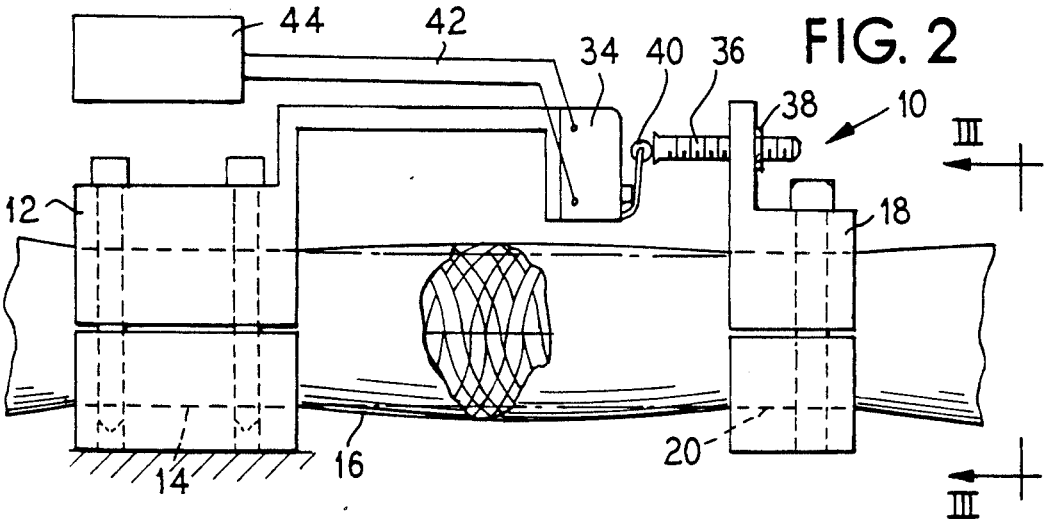
FIG. 2 is a side elevational view of the mechanical pressure switch of FIG. 1 shown in a high pressure configuration.
Figure 4:
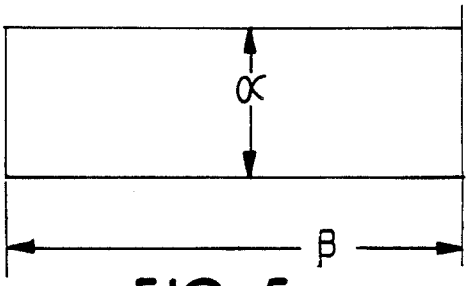
FIG. 4 is a diagramatic illustration of the dimensions of the expandable and contractable hose portion shown in a low pressure configuration.
Figure 5:
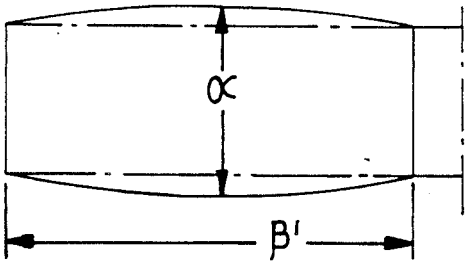
FIG. 5 is a diagramatic illustration of the dimensions of the expandable and contractable hose portion shown in a high pressure configuration.

As illustrated diagramatically in FIGS. 4 and 5, in a low or no pressure environment, the longitudinal or axial distance between the two split blocks 12, 18 is identified as $\beta$ and the diameter or lateral dimension of the conduit is identified as $\alpha$. In the illustrated embodiment the conduit is circular, and the diameter $\alpha$ is equal to both the height and the width of the outer wall of the conduit 16. The longitudinal length $\beta$ extends perpendicularly to the height and width, i.e. diameter, of the conduit. As shown in FIG. 3, the height H and width W of the conduit 16 define an opening O to the source of pressurized fluid P. As pressure within the conduit increases, the diameter of the hose increases which causes a contraction in the longitudinal dimension of the hose as illustrated in FIGS. 2 and 5 wherein the longitudinal length decreases to $\beta'$ and the maximum diameter of the hose increases to $\alpha'$. When this occurs, the actuator projection 36 is caused to move into engaging contact with the actuator element 40 of the microswitch 34. Depending upon the particular type of microswitch employed and the configuration of the control 44, as an example, engagement of the actuator projection 36 with the microswitch actuator 40 could cause an element such as a pump to turn off at a certain pressure level in response to the longitudinal contraction of the conduit. As pressure within the conduit decreases, the second split block 18 will move away from the first split block resulting in disengagement of the actuator projection 36 from the actuator element 40 which, may cause the pump to be turned on again. Other types of elements could be controlled in response to pressure changes within the conduit such as opening and closing of valves.

With the adjustable nature of the actuator projection 36, the microswitch 34 can be opened and closed at selected varying pressures as determined by the operator. This also permits the pressure switch to be adjusted precisely without requiring precise placement and spacing of the two split blocks 12, 18.

It will of course be understood by those skilled in the art that the herein described principle of the mechanical foreshortening of the length of the braided conduit can be employed with differing types of sensing devices to establish fine control of the pressure in the conduit. For example, a relative motion sensing means could be applied to the split blocks 12, 18 to determine the relative distance between the blocks at any given sampling time. This information could be input to a microcomputer, the output of which effectively controls the pressure producing pump. From a simple on/off control system to an adjustable pressure maintenance system can be created utilizing the herein disclosed principle of mechanical pressure foreshortening of the conduit. It is believed that a system utilizing a simple distance measurement system such as a sonar based system or a magnetic field measurement system could be employed between the two split blocks such that the signal output from one sensor would vary in relation to the distance between the split blocks. A simple on/off switch could operate as a threshold sensor from the output of the signal sensor whereas a more controlled variable system could be utilized to maintain pressure within a range by means such as controlling a variable speed drive to the pump in response to the signal strength from the distance sensor. Thus, for example if switch 34 were a magnetic field strength responsive variable output sensor and if actuating projection 36 were a permanent magnet and then it will be seen that the signal output through lines 42 to control 44 would vary dependent upon the space between switch 34 and actuating projection 36. If control 44 is a threshold limit control, the output from 44 can operate as an on/off switch for the pump or a control for a bypass valve. If, on the other hand control 44 is a variable analog or digital processor, the output from switch 34 can be utilized to provide a more sophisticated control operating either a variable displacement pressure release valve to maintain pressure within a given limit or to control a variable speed drive to the system pressure pump or other pressure source. It will of course be understood that other types of sensor systems may be utilized such as Hall effect switches, sonar switches of the type utilized in setting automatic focus cameras, magnetic or electric field sensing devices or optical interferometers or the like.

Figure 6:
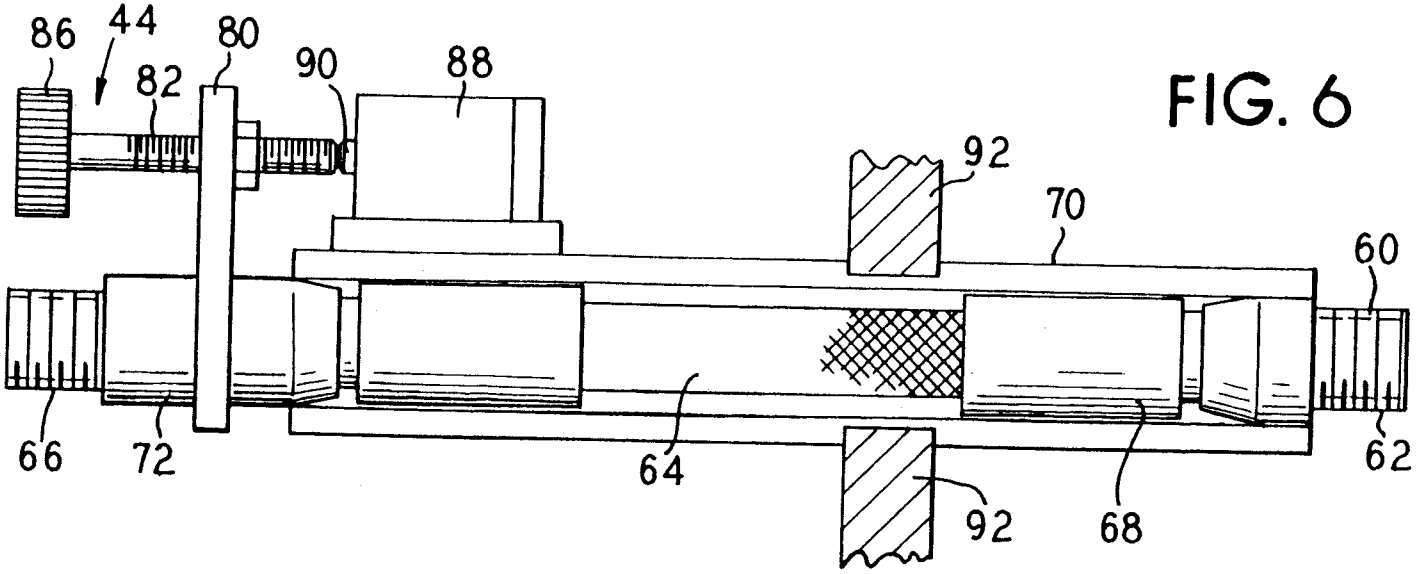
FIG. 6 is a side elevational view of another mechanical switch acuator embodying principles of the present invention shown in a low pressure configuration.
Figure 7:
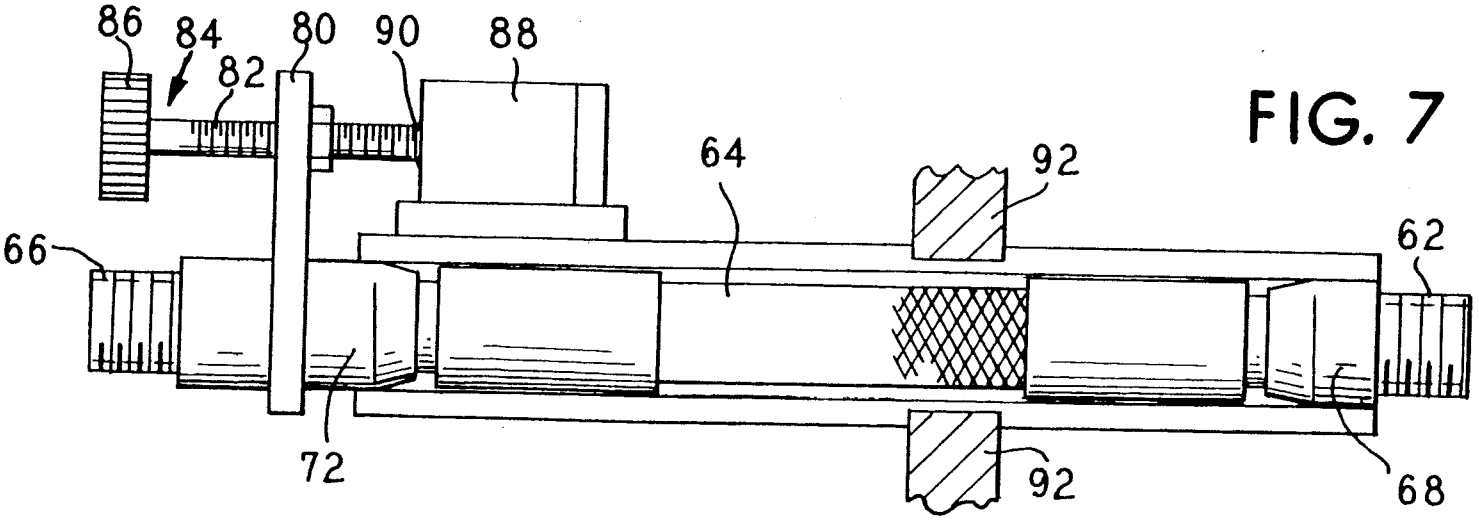
FIG. 7 is a side elevational view of the mechanical switch of FIG. 6 shown in a high pressure configuration.

An alternate embodiment of the invention is illustrated in FIGS. 6 and 7. A low pressure configuration is shown in FIG. 6. A high pressure configuration is shown in FIG. 7.

In the embodiment of FIGS. 6 and 7, a braided hose 60 is divided into three portions 62, 64, and 66. Portion 62 engages a fitting 68 that is secured within a tubular member 70. Portion 64 engages between the secured fitting 68 and an unsecured fitting 72, with the tubular member 70. Portion 66 engages the opposite end of the fitting 72.

Because the portion 62 is secured to the tubular member 70 by means of the fitting 68, it is referred to as the fixed or secured end of the hose 60. In contrast, because the portion 66 engages the fitting 72 which is not secured to the tubular member 70, the portion 66 is referred as the unsecured or free end of the hose 60.

As illustrated, the tubular member 70 is designed so that as the pressure within the hose portion 64 increases, the hose portion 64 will expand and the fitting 72 will move toward the fitting 68. Accordingly, the interior of the tubular member operatively permits the fitting 72 to freely slide therein.

As also illustrated, a bracket 80 is attached to and carried by the fitting 72. It can be appreciated that as the fitting 72 slides, so does the bracket 80.

Extending through the bracket 80 in operative threaded engagement, is a threaded portion 82 of a thumbscrew 84. A knurled knob or head 86 is provided for turning of the screw 84 to cause the threaded portion to move relative to the bracket 80. Accordingly, the thumbscrew 84 is adjustable in position along an axis defined by the hose 60.

A microswitch 88 is secured to the tubular housing 70 adjacent an end from which projects the fitting 72. As the hose portions 64 and 66 expand and contract, the microswitch 88 remains static relative to the fitting 68 and the secured portion 62 of the hose 60.

It can be appreciated from FIGS. 6 and 7 that as the hose portions 64 and 66 expand and contract under various internal pressure loads, the bracket 80 and thumbscrew 84 therein will be caused to move relative to the microswitch 88. By placing switch actuator 90 of the microswitch 88 along the line of movement of the thumbscrew, the end of the threaded portion 82 of the thumbscrew 84 can be used to depress the actuator 90. Hence, as the pressure within the hose 60 increases, the hose portion 64 will expand and cause the thumbscrew to depress the actuator 90 of the microswitch 88. Thus, the depression of the actuator 90 can be used to determine when a selected pressure has been reached within hose 60.

It can be appreciated that the thumbscrew can be adjusted so as to cause actuation of the switch 88 at any number of selected pressure simply by turning of the screw 84 until the end of the threaded portion 82 is located at a selected distance from the actuator 90.

Preferably, the hose 60 is a braided hose that expands outwardly under the influence of pressure within. Other suitable hoses will be apparent to those knowledgeable in the art. Additionally, the shape of the interior of the tubular member 70 is unimportant so long as the fitting 72 can operatively slide therein in response to expansion of the portion 64.

Finally, the tubular member 70 is illustrated as being secured within a wall 92 of a housing. However, it is not imperative that the member 70 be so secured. It is only necessary that one portion of the hose 60 be held fixed relative to the switch 88, while another free portion is not, a switch actuating mechanism, e.g., the thumbscrew 84 being attached to the free portion.

Although the particular embodiments illustrated contemplate utilizing the longitudinal or axial contraction and expansion as the actuating movement, the present invention also contemplates utilizing the lateral or diametrical contraction and expansion as an actuating movement. The actuator projection may be formed as a part of the conduit and the position of the microswitch may be adjustable in the actuating direction rather than the actuating projection.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

I claim as my invention:

1. A mechanical pressure switch comprising:

a conduit carrying a flow of pressurized fluid in a predetermined longitudinal direction;

said conduit being expandable in a lateral dimension substantially transverse to said predetermined longitudinal direction in response to an increase in pressure of said pressurized fluid, said lateral expansion effecting a longitudinal contraction of said conduit along an axis substantially parallel to said predetermined direction;

a pair of separate means spaced along said conduit for restraining two longitudinally spaced portions of said conduit against lateral expansion, said restraining means being longitudinally movable relative to one another;

switch means, carried on a first of said restraining means, for opening and closing an electrical circuit;

actuating means, carried on a second of said restraining means, for engagement with said switch means solely upon a selected degree of said longitudinal contraction of a section of said conduit extending between said two restraining means.

2. A mechanical pressure switch according to claim 1, wherein said conduit comprises a braided hose.

3. A mechanical pressure switch according to claim 1, wherein said switch means comprises a microswitch.

4. A mechanical pressure switch according to claim 1, wherein said actuating means comprises a longitudinally adjustable projection.

5. A mechanical pressure switch according to claim 4, wherein said actuating means comprises an externally threaded cylinder and said second restraining means includes an internally threaded aperture oriented longitudinally.

6. A mechanical pressure switch according to claim 1, wherein one of said restraining means is fixedly mounted to a support external of said pressure switch.

7. A mechanical pressure switch comprising:

a conduit for carrying a pressurized fluid;

said conduit being expandable in a lateral dimension in response to an increase in pressure of said pressurized fluid, said lateral expansion effecting a longitudinal contraction of said conduit;

separate means for restraining two spaced portions of said conduit against lateral expansion;

switch means carried on a first of said restraining means;

actuating means carried on a second of said restraining means engageable with said switch means upon a selected degree of longitudinal contraction of said conduit extending between said two restraining means;

wherein said restraining means comprises a split block having opposing recesses shaped complementarily to said conduit which engage a circumferential portion of said conduit.

8. A pressure-actuated device comprising:

conduit longitudinally extending means for carrying a pressurized fluid;

said conduit means including outer wall means for defining an opening to a source of said pressurized fluid, said opening having a height and width, with said conduit being expandable and contractable in a longitudinally actuating direction perpendicular to said height and width of said opening in response to pressure changes of said pressurized fluid;

a pair of separate means spaced along said conduit for restraining two longitudinally spaced portions of said conduit against lateral expansion, said restraining means being longitudinally movable relative to one another;

motion detecting means mounted on one of said restraining means in a fixed position relative to a first of said portion of said conduit means spaced longitudinally from the second portion of said conduit means;

said motion detecting means including means for emitting a signal solely responsive to a sufficient movement of said second conduit portion relative to said first conduit portion in said longitudinal actuating direction.

9. A device according to claim 8, wherein said motion detecting means is mounted on a bracket clamped to said conduit means.

10. A device according to claim 8, wherein said motion detecting means comprises a switch mounted on said first portion of said conduit means and an actuation means mounted on said second portion of said conduit means.

11. A device according to claim 10, wherein said second conduit portion moves longitudinally to engage said actuation means with said switch means.

12. A device according to claim 11, wherein said actuation means is longitudinally adjustable relative to said switch means at a given fluid pressure level.

13. A device according to claim 10, wherein a spacing of said switch means and said actuation means is selectively adjustable in said actuating direction.

14. A mechanical pressure switch comprising:

a braided hose for carrying a pressurized fluid;

said hose being expandable diametrically in response to an increase in pressure of said pressurized fluid, said diametrical expansion effecting an axial contraction of said hose;

first and second split block means for clampingly encircling two spaced portions of said hose;

a microswitch carried on said first split block means;

an actuating projection carried on said second split block means and engageable with said microswitch upon a selected degree of longitudinal contraction of said hose extending between said first and second split block means.

15. A mechanical pressure switch according to claim 14, wherein said actuating projection is longitudinally adjustable relative to said second split block means.

* * * * *